US005370161A

United States Patent [19]

Shafer

[11] Patent Number: 5,370,161

[45] Date of Patent: Dec. 6, 1994

[54] BALLOON VENDING MACHINE

[76] Inventor: Erik J. Shafer, 1928 N. Halsted, Chicago, Ill. 60614

[21] Appl. No.: 87,665

[22] Filed: Jul. 6, 1993

[51] Int. Cl.[5] ..... B65B 3/16

[52] U.S. Cl. ..... 141/114; 141/165; 141/171; 141/281; 141/369

[58] Field of Search ..... 141/114, 129, 164, 165, 141/166, 171, 173, 176, 178, 179, 263, 281, 313, 369, 167; 53/434

[56] References Cited

U.S. PATENT DOCUMENTS

| | | | |
|---|---|---|---|
| 3,191,801 | 6/1965 | Standish | 221/14 |
| 3,380,490 | 1/1966 | Ellenberg | 141/167 |
| 3,536,110 | 11/1971 | West | 141/137 |
| 3,580,303 | 5/1971 | Roberge | 141/173 |
| 3,616,569 | 11/1971 | Litt | 46/90 |
| 3,616,823 | 11/1971 | Dello Iacono | 141/137 |
| 3,911,974 | 10/1975 | Kuykendall | 141/94 |
| 3,994,324 | 11/1976 | Zeyra | 141/349 |
| 4,088,161 | 5/1978 | Ikemoto | 141/167 |
| 4,094,347 | 6/1978 | Ikemoto | 141/313 |
| 4,167,204 | 9/1979 | Zeyra | 141/348 |
| 4,911,379 | 1/1989 | Kopelman | 244/31 |
| 5,016,428 | 5/1991 | Helling | 53/403 |
| 5,067,301 | 11/1992 | Shore | 53/79 |
| 5,121,595 | 6/1992 | Shore | 53/79 |

*Primary Examiner*—Ernest G. Cusick
*Assistant Examiner*—Steven O. Douglas
*Attorney, Agent, or Firm*—Niro, Scavone, Haller & Niro

[57] ABSTRACT

A balloon vending machine having a number of uninflated balloons positioned in a balloon support structure housed within the balloon vending machine. Attached to each balloon is a valve that not only maintains the balloon in the support structure but facilitates the inflation of the balloon. An operator selects one of a variety of balloons available for inflation. By rotating the balloon support housing the various balloons. Once the operator selects a balloon for inflation, the chosen balloon is indexed within the balloon support structure. The balloon is then inflated by dispensing a pressured gas through a series of regulators while still positioned in the balloon support structure. After the balloon is completely inflated, the inflator transports the balloon to a balloon hatch for delivery to the operator. The balloon hatch prohibits the operator from having access to the internal working of the balloon vending machine while retrieving the inflated balloon.

30 Claims, 6 Drawing Sheets

BALLOON VENDING MACHINE

BACKGROUND OF THE INVENTION

The present invention relates to a balloon vending machine in which an operator selects one of a variety of available balloons and activates the device which inflates the selected balloon, transports the inflated balloon to an inflation chamber and delivers the balloon through a balloon hatch.

SUMMARY OF THE INVENTION

A balloon vending machine has already been suggested by U.S. Pat. Nos. 4,088,161 and 3,380,490. For example, U.S. Pat. No. 3,380,490 disclosed a balloon vending machine in which the noninflated balloons are placed on a long belt. The belt is then intermittently advanced by a drive wheel so as to align each balloon in a step-by-step manner with a nozzle located at an inflating station. The disadvantage of such a system is, one, that it is difficult to load the balloons into the belt and, two, that it is difficult to load new balloons into the system until all the old balloons have been consumed. Further, it is difficult to select a particular type of balloon with the belt-fed system because the balloons are arranged in a predetermined fashion on the belt.

Another type of balloon vending machine has been suggested by U.S. Pat. No. 4,088,161 which discloses a system in which balloons are stacked in parallel storage rails projected upwardly on a turn table. The balloons are then conveyed along a second set of rails by a gas supplying means to the chamber in which the balloons are to be inflated. The disadvantage of the system is the mechanical complexity of moving the balloon from its storage apparatus to a separate filing chamber for inflation of the balloon. The other disadvantage of the system is that the operation mechanism and uninflated balloons are accessible to the purchaser when he opens the door to remove the inflated balloon from the filing chamber.

Accordingly, one of the objects of the present invention is to provide a machine in which uninflated balloons are stored, having an operating mechanism that, when activated, indexes and inflates the balloon within the confines of the machine, thereafter releasing the inflated balloon to the operator of the machine.

Another object of the present invention is to provide an improvement over the prior storage systems in which the uninflated balloons were maintained along a flexible belt. The improvement allows uninflated balloons having a check-valve inserted therein to be positioned between a series of rigid parallel rails affixed to a balloon storage carousal. In the new storage system, the balloon selected for inflation is inflated without the need to move the balloon/valve combination from the balloon storage carousal.

Yet another object of the present invention is the method for indexing the uninflated balloon whereby the indexing arm is used to sort the balloon for inflation, thus, providing a means for inflating one balloon selected by an operator while it is stored in the balloon storage carousal without disrupting the other balloons.

An additional object of the present invention is provided in the inflation nozzle which inflates and releases the balloon from the storage rails without the need to transport the uninflated balloon to a separate inflating chamber and without the need for separation of the check valve once the balloon has been inflated. Thus, the inflation nozzle not only inflates the balloon while it is still positioned along the vertical storage rails, but it also effectuates the release of the balloon from the vertical storage rails once the balloon has been fully inflated.

A further object of the invention is a mechanism attached to the balloon storage facility in which the inflated balloon is made available to the machine operator while, at the same time, preventing the operator from accessing the balloon storage and inflation mechanisms.

Another object of the present invention is provided in the balloon selection process in which an operator pushes a single button that rotates the balloon storage carousal until a display card depicting the desired balloon is displayed. The type of balloon selected is then aligned with the inflation nozzle and in a position to be inflated once the inflation mechanism is activated.

A final object of the present invention is to provide a reliable and cost-effective device that is both reliable and durable.

DETAILED DESCRIPTION OF THE PREFERRED EMBODIMENT

Figure 1:
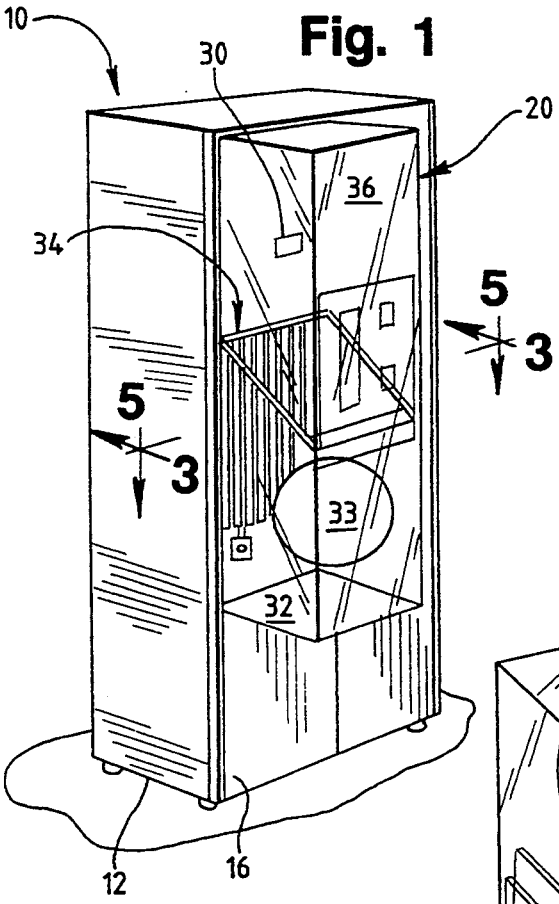
FIG. 1 is a perspective view of the balloon vending machine embodying the invention.
Figure 2:
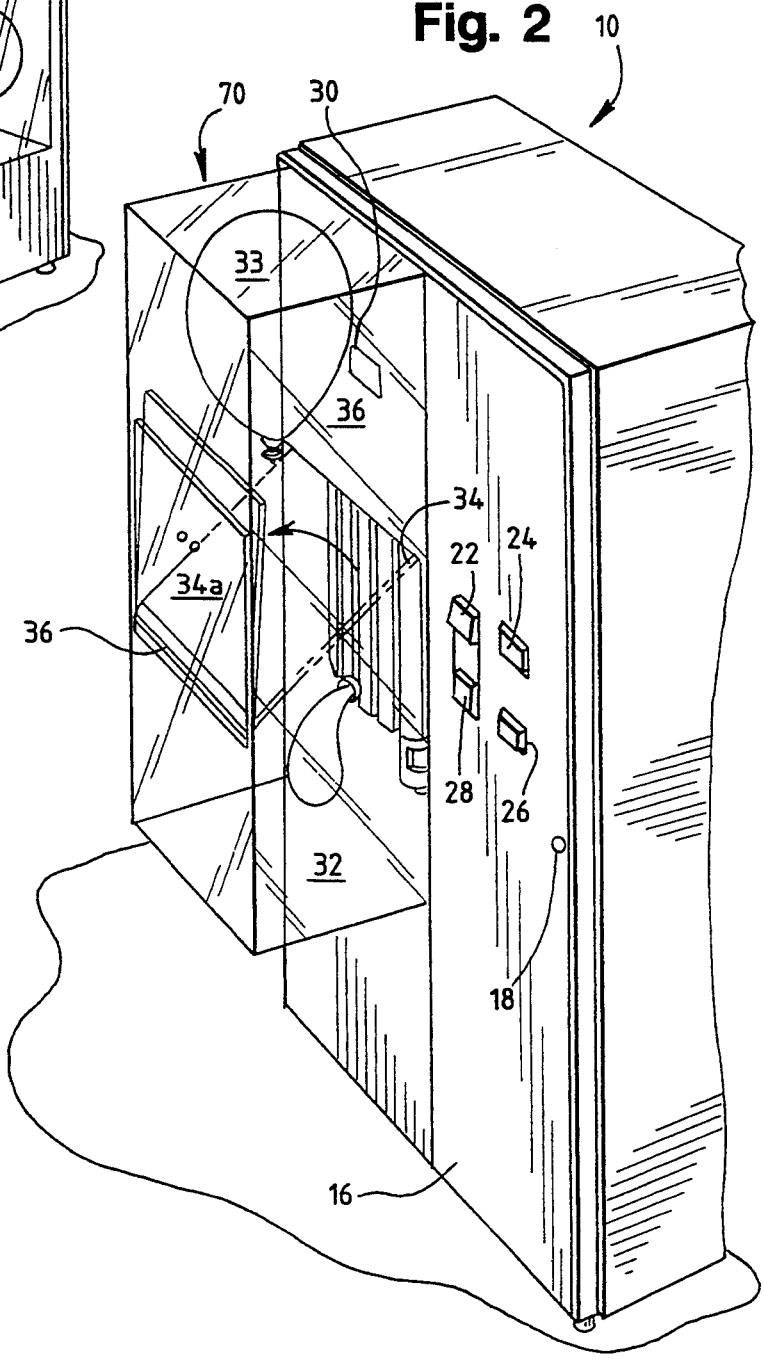
FIG. 2 is a perspective view of the balloon vending machine embodying the invention.

As shown in FIGS. 1 and 2, one embodiment involves a balloon vending machine 10 comprising a main cabinet 12 that is enclosed by main cabinet sides 14 and a hinged front door 16. The main cabinet sides 14 are comprised of two spaced, parallel and substantially vertical sides, as well as sides on the back, top and bottom.

The described main cabinet configuration is by way of illustration of the preferred embodiment, not limitation, as other suitable cabinet configurations can readily be substituted. The cabinet can be made out of any structural material, including sheet metal, glass, plastic or wood. Attached to the main cabinet 12 is the hinged front door 16 that allows access to the inside of the balloon vending machine 10 after unlocking a front door lock 18. The hinged front door 16 holds an enclosed balloon hatch 20, a coin slot 22, a selector button 24, an inflation button 26, a gas out indicator 28 and a view hole 30 where a person can observe which balloon type is currently ready to be purchased and inflated. The enclosed balloon hatch 20 is made out of a durable transparent material, such as plastic, and comprises a balloon inflation chamber 32 where a purchased balloon is inflated and a balloon trap door 34 which lets the purchased balloon pass to a balloon retrieval chamber 36.

The enclosed balloon hatch 20 can be seen in greater detail in FIG. 2. It is attached to the hinged front door 16 of the balloon vending machine 10. The balloon hatch 20 can either be glued, riveted or attached to the front door 16 by any other suitable means. The enclosed balloon hatch 20 also has two chambers, specifically, the balloon inflation chamber 32 which is positioned below the balloon retrieval chamber 36. The balloon retrieval chamber 36 is separated from the balloon inflation chamber 32 by the balloon trap door 34 that is hingeably attached by a trap door hinge 38 to a front wall portion of the balloon inflation chamber 32.

The balloon hatch 20 operates in the following manner. An uninflated balloon protrudes into the balloon inflation chamber 32. As the balloon 33 fills with helium, it expands into the balloon inflation chamber 32. After the balloon 33 is filled, it is released into the balloon inflation chamber 32 and rises until it contacts the balloon trap door 34. If the balloon trap door 34 is in the closed position **34*a*, the balloon will rise into the balloon retrieval chamber 36. The operator must move the balloon trap door 34 to the closed position 34*a*, thereby permitting the inflated balloon 33 to float into the balloon retrieval chamber 36. The balloon hatch door 34 is positioned such that the operator can reach the internal parts of the balloon vending machine 10**.

Figure 3:
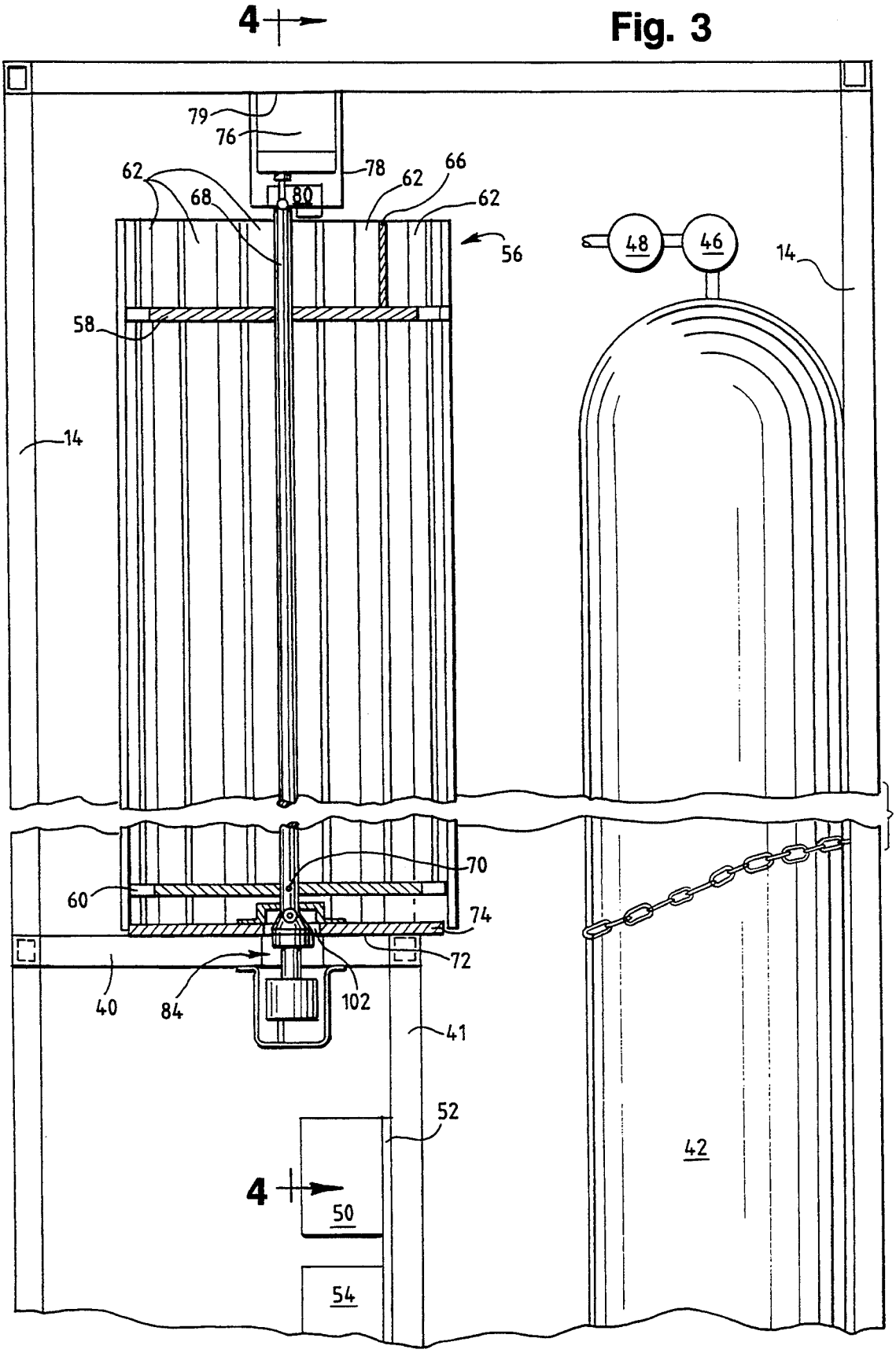
FIG. 3 is a front elevational view of the internal structure of the balloon vending machine with a cross-section of the balloon storage mechanism to expose the essential components of the machine.
Figure 4:
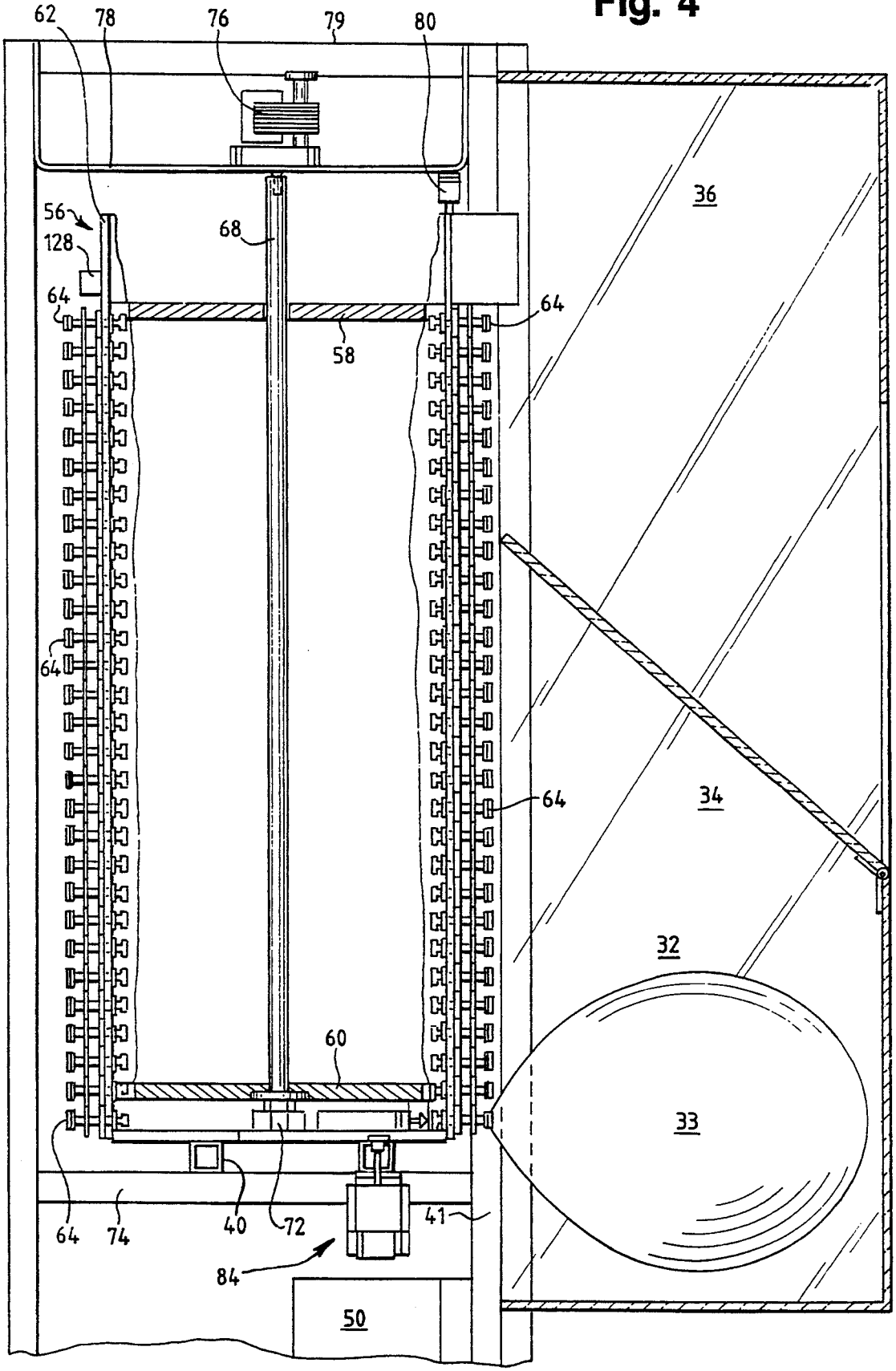
FIG. 4 is a side elevational view of the internal structure of the balloon vending machine with a cross-section of the balloon storage mechanism to expose the essential elements of the machine.
Figure 5:
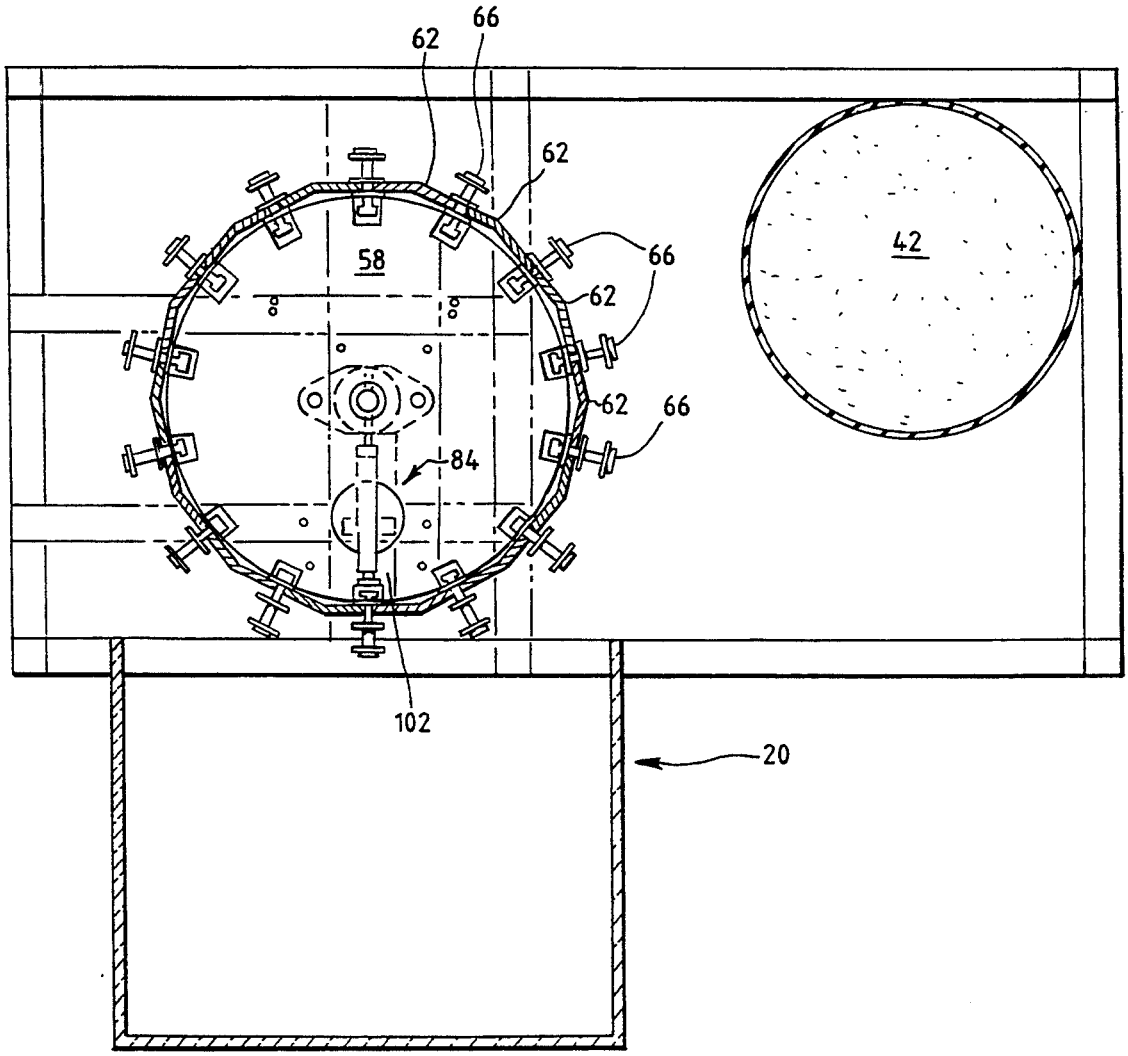
FIG. 5 is a plain view of the internal structure of the balloon vending machine showing the storage rails and the inflation nozzle.

As shown in FIGS. 3–5, internal structure (described below) of the balloon vending machine 10 is supported by a main support frame 40 that includes four legs for support 41. Abutting one of the two vertical sides 14 is means for providing pressurized gas 42. In the preferred embodiment, the means for providing pressurized gas is a pressurized gas tank 42 which rests on the bottom of the main cabinet 12. The pressurized gas tank 42 is stabilized by a chain 44 which is attached to one or more of the main cabinet sides 14.

As shown in FIG. 3, the balloon vending machine 10 has internal operating device within the main cabinet 12. Gas, preferably helium, is supplied in the balloon vending machine 10 from the pressurized gas tank 42 through a first regulator 46, then through a second regulator 48. These regulators 46,48 combine to reduce the pressure of the gas exiting from the pressurized gas tank 42 to a manageable level more in accordance with the size of balloon to be inflated. The first regulator 46 can be of a type similar to a Sherwood CDC358 regulator, which reduces the pressure of the helium exiting the pressurized gas tank from approximately 2000 PSI (or lower as the helium supply diminishes) to approximately 80 PSI. The second regulator 48 reduces the pressure of the helium tank from 80 PSI to 40 PSI. The second regulator 48 should be of a type similar to a Wilkerson R001-01-L00 regulator.

A side plate 52 attached to the main frame 41 which supports a programmable logic controller (PLC) 50 and a valve stack 54. The side plate 52 is affixed to the frame legs 41 by means of a weld, glue or other suitable means. The programmable logic controller 50 can desirably be a Mitsubishi FX014MR-ES/UL type programmable type controller or a similar type PC. Standard U.S. outlet electricity (110 VAC) is used to power the PLC 50. The PLC 50 is programmed with a set of instructions that electronically interact with the mechanical operations of the balloon vending machine 10. Some of the instructions programmed into the PLC 50 include instructions for the selection of the balloon for inflation and the operation of the inflator 84, the delivery of the helium to the uninflated balloon and the operation to release the balloon. Details of these operations are discussed below.

The rotating balloon storage carousal 56 is positioned above the main support frame 40. The rotating balloon storage carousal 56 is comprised of an upper rail support disc 58 and a lower rail support disc 60, both of which are generally circular in shape. Attached along the perimeter of the upper 58 and lower 60 rail support discs are a plurality of vertical rails 62.

The vertical rails 62 are spaced at intervals around the upper rail support disc 58 and lower rail support disc 60 to allow one or more balloon valves 64 to pass in vertical slots 66 formed between adjacent vertical rails 62. The balloon valves 64 are stacked in the spaces between adjacent vertical rails 62. Each of the vertical rails 62 is also located substantially the same distance from the center of the rotating carousal. The balloon valves 64 are loaded into vertical slots 66 at the top of the rotating balloon storage carousal 56. The vertical slots 66 run the entire rail length and are the substantially the same width, top to bottom, and are spaced such that gravity alone can cause the balloon valves 64 to slide down in the vertical slots 66 between the vertical rails 62. Through the center of the rotating balloon storage carousal 56 is a center shaft 68 that is securely held to the lower rail support disk 60, and thus the balloon storage carousal 56, by a pin 70. The upper rail support disc 58 and the lower rail support disc 60 are adapted to receive the center shaft 68 through a center axis of the rail support disks 58,60. The center shaft 68 extends substantially vertically through the upper and lower rail support discs 58,60. As part of the internal structure of the balloon vending machine 10, the center shaft 68 is held in place at its lower end by a bearing 72 which sits atop and is attached to a fixed base plate 74. The fixed base plate 74 may be bolted or welded to the main support frame 40. The center shaft's 68 upper end is connected to a gear motor 76. Methods, such as pinning or coupling, but not limited thereto, could be used to connect the center shaft 68 and gear motor 76. The gear motor 76 is attached to a support bracket 78, for example by bolting the gear motor 76 to the support bracket 78. The support bracket 78 is attached to the upper support frame 79.

The gear motor 76 is activated when the selector button 24 is pushed. A signal is sent from the selector button 24 to the PLC 50 through a wire. The PLC 50 then activates the gear motor 76. When the gear motor 76 is activated, the rotating balloon storage carousal 56 rotates until a micro switch 80 senses the presence of a vertical slot 66 located between two vertical rails 62. The micro switch 80 is a contact type switch that will open an electric switch when the detector mechanism falls into the vertical slots 66 and closes the switch when the detector mechanism rides on the top of the vertical support rails 62. The micro switch 80 may alternatively be a photo-electric type sensor.

The micro switch 80 is attached to the support bracket 78. When the micro switch 80 senses the next vertical slot 66 that it encounters, a signal is sent to the PLC 50 which in turn causes the gear motor 76 to stop. The rotating balloon storage carousal 56 stops at every vertical slot 66 and accurately aligns a center axis of a particular balloon valve 64 with a center axis of an inflation nozzle 82.

Within the rotating balloon storage carousel 56, and positioned adjacent the carousel's 56 bottom is an inflator 84, which is shown in detail in FIGS. 6–9. The inflator 84 inflates one balloon/valve combination 86 at a time and ejects that balloon/valve combination 86 from its vertical slot 66.

The inflator 84 includes the inflation nozzle 82, the support bracket 106, the in/out cylinder 94, and the up/down cylinder 98. The inflation nozzle 82 is attached to an in/out cylinder 94. The in/out cylinder 94 controls the movement of the inflation nozzle 82 along the horizontal plane. The in/out cylinder 94 is affixed to the support bracket 106 by a weld or other suitable means. The support bracket 106 is affixed to the up/down cylinder 98. The up/down cylinder 98 controls the vertical movement of the support bracket 106, the in/out cylinder 94 and the inflation nozzle 82.

The inflation nozzle 82 has two ends, specifically, an outer nozzle end 88 and an inner nozzle end 90. The outer nozzle end 88 is designed for insertion into the balloon/valve combination 86 and may utilize an O-ring 92 to form a substantially gas-tight seal between the inflation nozzle 80 and the balloon/valve combination 84. The O-ring 92 may be radially positioned around the outer nozzle end 88.

Figure 6:
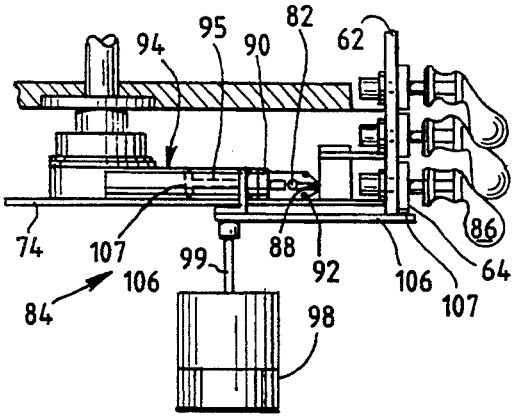
FIG. 6 is a partial side view of the inflation nozzle and indexing means prior to the inflation of the balloon.

FIG. 6 depicts the position of the inflator 84 in relation to the rotating carousal 56 during the selection mode of operation. The up/down cylinder 98 is in the up position such that the balloon inflator 84 protrudes through an opening 102 in the base plate 74. The support bracket 106 prevents the balloon/valve combinations 86 from becoming dislodged from the vertical rails 62. The support bracket 106 also contains a ridge 107 that contacts the lower portion of the vertical rails 62 to prevent the vertical rails 62 from being bent. The balloon inflator 84 has a spring loaded in/out cylinder rod 95 that is affixed to the inner nozzle end 90 of the inflation nozzle 82. The in/out cylinder rod 95 which passes through an opening in/out cylinder 94 is connected to an in/out plunger 107 located inside the in/out cylinder 94. The in/out cylinder 94, as well as the up/down cylinder 98, are operated by pneumatics.

Thus, during the selection mode of operation, helium from the pressurized gas tank 42 is transported through the valve stack 54 and into the up/down cylinder 98. The air pressure of the helium in the up/down cylinder moves the up/down cylinder rod 99 to its extended position and maintains the up/down cylinder rod 99 in the extended position.

Figure 7:
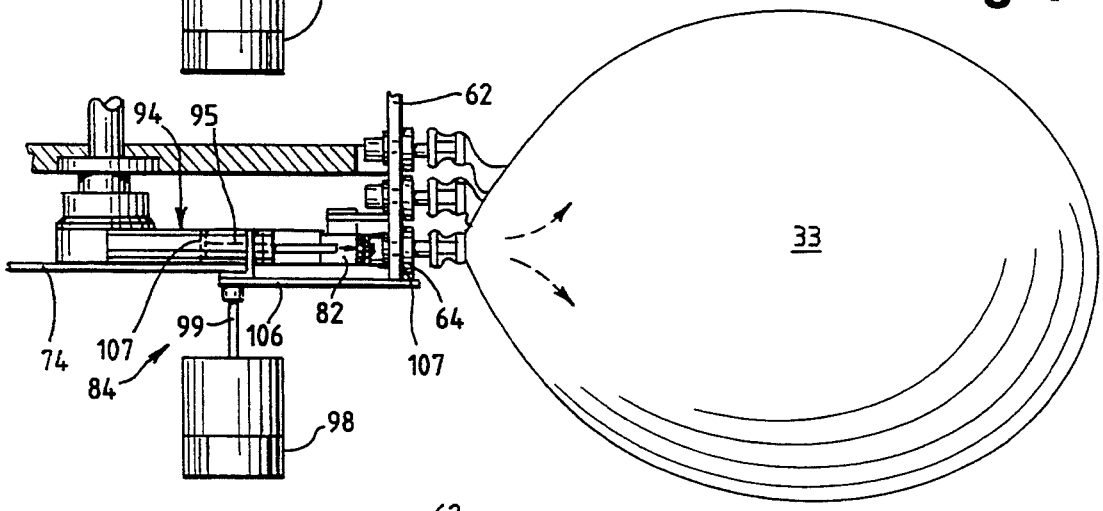
FIG. 7 is a partial side view of the inflation nozzle and indexing means during the inflation of the balloon.

During operation of the inflator 84, as depicted in FIG. 7, helium from the pressurize gas tank 42 is passed into the receiving port 105 of the in/out cylinder 94. The pressure produced by the helium stream creates a force on the in/out plunger 107 and the spring 109 to move the in/out plunger 107 and the in/out cylinder rod 99 to the out position. The inflation nozzle 82 is thus inserted into the neck of the balloon/valve combination 64. After the inflation nozzle 82 is inserted into the balloon/valve combination 64, helium from the pressurized gas tank 42 is supplied through the inner inflation nozzle end 90 and into the balloon/valve combination 64 and inflating the balloon 64 through the outer inflation nozzle end 88.

Figure 8:
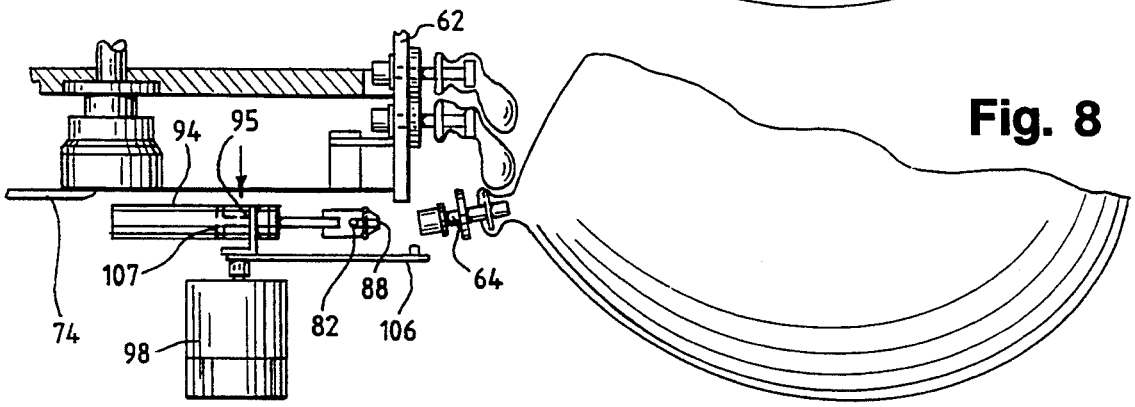
FIG. 8 is a partial side view of the inflation nozzle and indexing means demonstrating indexing and release of the inflated balloon.

Upon completion of the inflation of the balloon 86, as depicted in FIG. 8, the helium from the pressurized tank is supplied to the up/down cylinder 98 to precipitate the downward movement of the up/down cylinder rod 99 into the up/down cylinder 98. When the up/down cylinder rod 99 is retracted, the support bracket 106 and the inflator 84 are lowered through the base plate opening 102 to a position below the base plate 74. As the up/down cylinder rod 95 retracts, the inner nozzle end 90 of the inflator 84 remains inserted in the neck of the balloon/valve combination 86. Thus, the balloon valve combination 86 is moved to a position below the lower portion of the vertical rails 62. During the inflation operation, the in/out cylinder rod 95 is not extended to its outermost position because the in/out cylinder rod 95 exerts a force through the inflation nozzle 49 and the balloon/valve combination 86 against the vertical rails 62. The ridge 107 of the support bracket 106 prevents the vertical rail 62 from bending outward due to the force exerted by the in/out cylinder 94. Therefore, as the inflator 84 with the balloon/valve combination 86 moves below the lower portion of the vertical rails 62, the in/out cylinder rod 95 protrudes forward along the vertical axis to propel the balloon/valve combination 86 from the vertical rails 62 and into the balloon inflation chamber 32. After the balloon/valve combination 86 is released, the inflator 84 can provide a short release of helium through the inner inflation nozzle 90 to help propel the balloon/valve combination 86 into the inflation chamber 32. The indexing arm 104 prevents any balloon/valve combinations 86 located in the vertical slots 66 from becoming dislodged from the vertical slot 66.

Figure 9:
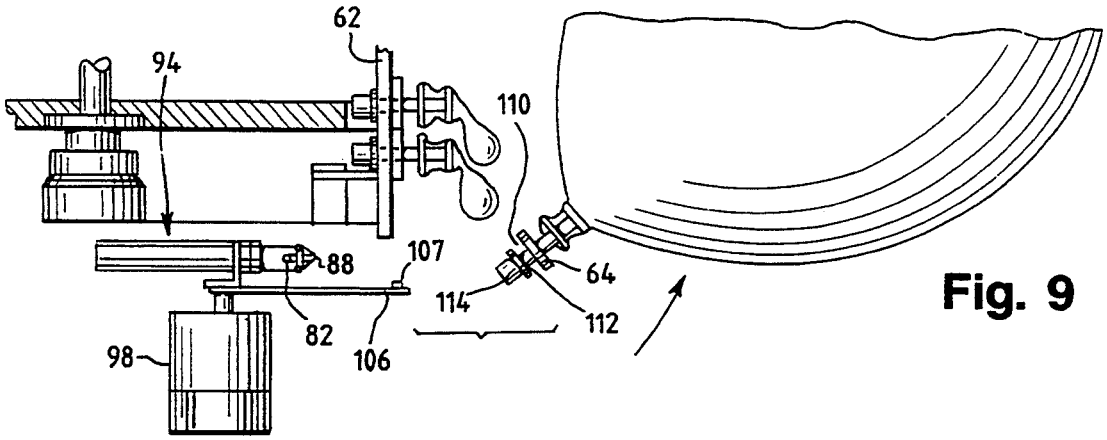
FIG. 9 is a partial view of the inflating nozzle and indexing means depicting the position of the retracted inflation nozzle after the balloon is released.

As shown in FIG. 9, after the balloon/valve combination 86 is released from the inflation nozzle 82, the up/down cylinder 98 is activated by a supply of helium to extend the up/down cylinder rod 99 to the up-most position. At the same time, the supply of helium to the in/out cylinder 94 is stopped to permit the spring 109 to be expanded causing the plunger 107 and the in/out cylinder rod 95 to move to the retracted position.

When the up/down cylinder 98 is activated, it raises up the in/out cylinder 94 and inflation nozzle 80 through a base plate opening 102 in the fixed base plate 74 which is bolted to the main support frame 40. Attached to the fixed base plate 40 is an indexing arm 104, and a rail support bracket 106. The indexing arm 104 is positioned above the base plate opening 102 which allows the up/down cylinder 98 to push the in/out cylinder 94 and inflation nozzle 80 through the base plate opening 102 and into a set and/or inflation position shown in diagrams 7, and 8. The indexing arm 104 allows a particular stack of balloon/valve combinations 86 to advance one at a time by separating the balloon/valve combination 86 on the bottom of the stack from the rest of the balloon/valve combinations 86 stacked above it. The rail support bracket 106 is attached to the up/down cylinder 98 and the fixed base plate 74. When the up/down cylinder 98 is in the set/up position, the rail support bracket 106, the in/out cylinder 94, and the inflation nozzle 82 are in a position where the end of the rail support bracket 106 contacts and holds the bottom side of some of the vertical rails 62. When the rail support bracket 106 is in position, the in/out cylinder 94 will push the inflation nozzle 82 towards and into the particular balloon/valve combination 86 being held in the vertical slot 66 that the inflation nozzle 82 is aligned with. The inflation entrance 108 allows gas to be transferred from the inflation nozzle 82 through the balloon valve 64 and into the balloon as further described below. If the rail support bracket 106 was not holding the bottom of the vertical rails 62, the pressure exerted on the vertical rails 62 from the inflation nozzle 82 could cause damage to the otherwise unsupported bottom sections of the vertical rails 62.

A representative balloon/valve combination 86 is illustrated in FIG. 9. The ribbon notch 110 contains a ribbon 112 which is wound radially around a tubular member 114 in the ribbon notch 110. One end of the ribbon 112 is secured to the tubular member 114. An inside rail flange 116 extends radially outward from the tubular member 114 and helps form the ribbon notch 110.

When any balloon/valve combination 86 is properly placed in the rotating balloon storage carousel 56 as shown in FIGS. 6–9, for example, the balloon/valve combination 86 has the inside rail flange adjacent to the interior side of the vertical rails 62, and the outside rail flange adjacent to the exterior side of the vertical rails 62. The interior side of the vertical rails is closer to the center axis of the rotating balloon storage carousel 56 than the exterior side of the vertical rails 62.

In the preferred embodiment, the balloon valve 64 is a modification of a check valve described in U.S. Pat. No. 4,167,204 ('204 patent), "Apparatus for Inflating Toy Balloons." The '204 patent check valve was modified in order to adapt it to usage in the balloon vending machine 10. The balloon valve 64 of the present invention is made of a plastic, although other materials could be used. The valve acts as a one-way check valve that allows gas to pass from the inflation nozzle 82, through in the tubular member 114, and into the balloon 100.

The basic mechanics of one form of the balloon vending machine 10 are set out below.

The balloon vending machine 10 can be installed by plugging the balloon vending machine 10 into a standard U.S. 110 VAC outlet, filling the machine with deflated balloon/valve combinations 86, and opening the pressurized gas tank's 42 valve. A power cord is hooked up to the PLC 50, and when the plug at the end of the cord is plugged in to an electrical outlet, the PLC 50 is activated. The deflated balloon/valve combinations 86 can be loaded into the vertical slots 66 by gripping the balloon valve 64 at the balloon neck flange 120 and sliding the balloon/valve combination 86 between the vertical rails 62. The balloon/valve combinations 86 are stacked on top of each other until the vertical slots 66 is full. Each of the vertical slots 66 around the rotating balloon storage carousal 56 are filled and can easily be refilled at any time. Once installation is completed, the balloon vending machine 10 is ready to produce inflated balloons upon demand.

Figure 10:
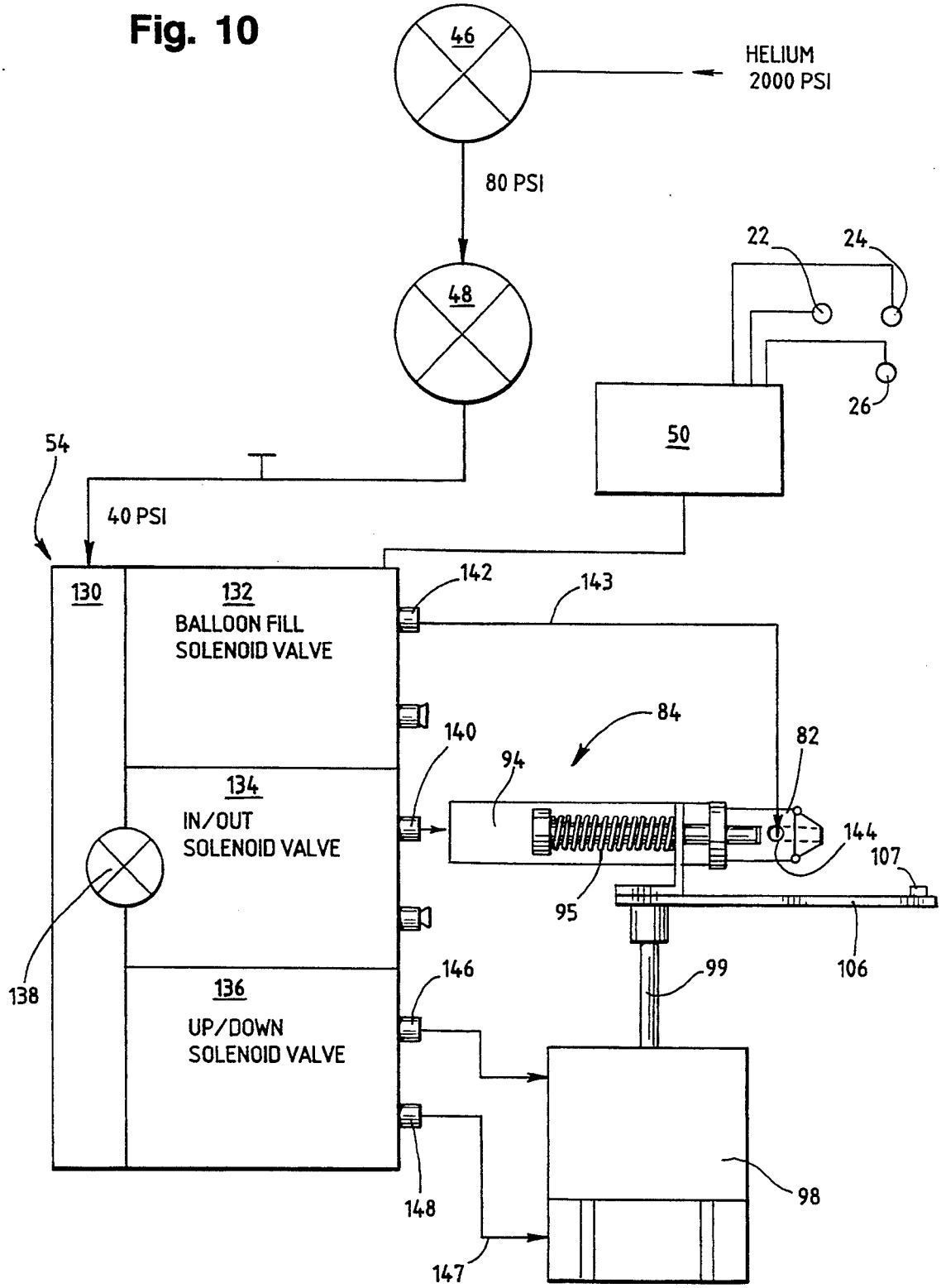
FIG. 10 is a schematic of the inflation nozzle and the helium delivery system.

The operation of the balloon vending machine 10 requires several steps. Reference to FIGS. 2 and 10 will be helpful in demonstrating the operation of the balloon vending machine 10.

First, an operator approaches the balloon vending machine 10 with the desire to purchase an inflated helium balloon. The operator must first push the balloon selector button 24 which sends a signal to the PLC 50. The PLC 50 interprets the signal and then sends a separate electrical signal to the gear motor 76 which activates the gear motor 76. The gear motor 76 rotates the center shaft 68 until a display card 128 having a picture of the inflated balloon is presented in the view hole 30. At this time, the microswitch 80 detects that the inflation nozzle 82 is lined up with the balloon valve combination 86 and sends a signal to the PLC 50 which, in turn, relays a signal to stop the gear motor 76. Once the selector button is released, the display card 128 of the desired balloon is displayed in the view hole 30 and the inflation nozzle 82 is lined up with the desired balloon/-valve combination 86.

Next, the operator must deposit the proper consideration, usually a coin or a token, in the coin slot 22. When the consideration is deposited through the coin slot, a coin slot sensor 126, located behind the coin slot, senses and identifies the coin or token deposited. If the coin or token deposit is proper, then a signal is sent to the PLC 50 which, in turn, readies the balloon inflator 84.

Once the type of balloon 100 is selected and the proper consideration is deposited through the coin slot 22, the operator must push the inflation button 26. Just prior to the time the inflation button 26 is pushed, a signal is sent to the PLC 50 which relays a signal to activate the inflator 84 and valve stack 54. The balloon inflator 84 is activated. The balloon inflator 84 remains in the set position until the inflation button 26 is pushed.

At this time, there is continuous air pressure supplied from the pressurized gas tank 42 through the first regulator 46 and second regulator 48 and into the valve stack 54. The valve stack 54 contains a manifold 130 into which the pressurized air from the second regular 48 flows. The valve stack has three separate chambers: a balloon fill chamber 132, an in/out chamber 134 and an up/down chamber 136. Gas that enters the in/out chamber 134 from the manifold 130 must pass through a third regulator 138 which lowers the air pressure from 40 psi in the manifold 130 to 20 psi in the in/out chamber 134. Each chamber has two ports that are controlled by a solenoid valve.

When the operator pushes the inflate button 26, a signal is sent to the PLC 50 and the PLC 50 recognizes that the balloon inflation process should begin. The PLC 50 then sends a signal to the in solenoid valve 140 located in the in/out chamber 134 of the valve stock 54 to open the in solenoid valve 140, thus, allowing pressurized helium to flow from the in/out chamber 134 through a flexible tube into the inflation nozzle 82 and out the outer nozzle end 88. The pressurized air flowing into the in/out cylinder 94 and forces the in/out cylinder rod 95 to an extended position which, in turn, pushes the inflation nozzle 82 into the neck 108 of the balloon valve combination 86.

After a predetermined time interval, the PLC 50 will recognize that the balloon is now ready to be filled with helium. The PLC 50 sends a signal to the balloon fill solenoid valve 142 that causes the balloon fill solenoid valve 142 to open, allowing pressurized helium gas to flow through the balloon fill solenoid valve 142 through a flexible tube 143 into an opening 144 in the inflation nozzle 82. For a predetermined amount of time programmed into the PLC 50, the helium gas flows through the inflation nozzle 82 out the outer nozzle 88 and into the balloon 108. The PLC 50 will recognize when the predetermined fill time has elapsed and the PLC 50 will then send a signal to the balloon fill solenoid valve 142 closing the balloon fill solenoid valve 142 to stop the flow of helium to the balloon. Once the balloon fill solenoid valve 142 is closed, the PLC 50 signals the down solenoid valve 146 opening the down solenoid valve 146 while, at the same time, sending a signal to the up solenoid valve 148 to close the up solenoid valve 148. When the down solenoid valve 146 is open, pressurized helium gas flows through the down solenoid valve 146 through a flexible tube 147 and into the up/down cylinder 98. The supply of pressurized helium into the up/down cylinder lowers the up/down cylinder rod 99. As the up/down cylinder is lowered, the balloon/valve combination 86 is released from the vertical rails 62. While the PLC 50 will be preprogrammed to send a signal to balloon fill solenoid valve 142, the balloon 108 is released to open the valve for a short period of time to allow a short flow of helium to flow through the inflate nozzle 82 in order to help push the inflated balloon 100 into the inflation chamber 32. Once the balloon fill solenoid valve 142 is closed, the PLC 50 sends a signal to in solenoid valve 140 and down solenoid valve 146 to close both valves. The spring 109 located in the in/out cylinder 94 exerts a force on the in/out plunger 97 that returns the inflation nozzle 82 to its original position. At the same time, the PLC 50 sends a signal to close the down solenoid valve 146. The PLC 50 sends a signal to the up solenoid valve 148, opening the up solenoid valve 148. Pressurized helium then flows through the up solenoid valve 148 through a flexible tube 147 and into the up/down cylinder causing the up/down cylinder rod 99 to extend to the upward-most position. The PLC 50 then sends a signal to activate the gear motor 76 which rotates the center shaft 68 of the rotating carousal 56 to rotate the rotating carousal 56 until the vertical slot 66 adjacent the vertical slot 66 containing the balloon/valve combination 66 chosen by the operator aligns with the microswitch 80. The microswitch sends a signal to the PLC 50 which, in turn, sends a signal to deactivate the gear motor 76.

This process happens very quickly. When the up/-down cylinder 98 moves down in the process described above, the inflation nozzle 82 is still engaged to the balloon/valve combination 86 and, therefore, pulls the balloon/valve combination 86 down and out of the vertical slot 66. The gas that inflates the balloon 100, preferably helium, is lighter than air so when the balloon/valve combination 86 comes out of the vertical slot 66, the inflated balloon/valve combination 86 will float up through the enclosed balloon hatch 20, in the balloon inflation chamber 32, to the balloon trap door 34.

The indexing arm 104 keeps the balloon/valve combinations 86 stacked above the now inflated and floating balloon/valve combination 86 from advancing downward. A person then pulls out the balloon trap door 34 so that the inflated balloon/valve combination 86 floats up to the balloon retrieval chamber 36. The person then pushes the trap door back so that they can reach in to the balloon retrieval chamber 36 and remove the floating balloon/valve combination 86. Finally, the ribbon 112 can be pulled from the balloon valve 64. The person can then walk away from the balloon vending machine 10 with a fully inflated balloon 100 with attached ribbon 112. The balloon vending machine 10 will now await the next customer. When the pressurized gas tank 42 runs low, a gas out indicator 28 will light up, indicating that the pressurized gas tank 42 must be refilled or exchanged with a full tank.

Of course, it should be noted that various changes and modifications to the preferred embodiments of this invention will be apparent to those skilled in the art, such changes and modifications can be made without departing from the spirit and scope of the present invention. It is, therefore, intended that such changes and modifications be covered by the following claims:

What is claimed is:

1. A balloon vending machine, comprising:

a balloon support structure for storing a plurality of balloon/valve combinations;

an indexer which indexes one of the balloon/valve combinations stored in the balloon support structure;

an inflator which inflates the indexed balloon/valve combination while the indexed balloon is generally maintained in its pre-indexing position within the balloon support structure;

a transporter which transports the inflated balloon/-valve combination from the balloon support structure.

2. The apparatus recited in claim 1, wherein the balloon support structure is further comprised of a plurality of vertical support rails to slidably receive the balloon/valve combinations wherein the balloon support structure is positioned on a base plate, with the base plate having an opening to receive the inflator.

3. The apparatus recited in Claim 1, wherein the plurality of vertical rails are spaced circularly around a common center axis.

4. The apparatus recited in claim 1, wherein the inflated balloon/valve combination is removed by the transporter from the support structure and released to a balloon hatch.

5. The apparatus recited in claim 4, wherein the balloon hatch has an upper and lower chamber, with the inflated balloon/valve combination being released from the machine in the upper chamber.

6. The apparatus recited in claim 1, wherein the balloon support structure is rotated by a motor.

7. The apparatus recited in claim 1, further comprising a controller which controls the movement of the balloon support structure, the inflater and the transporter.

8. The apparatus recited in claim 1, wherein the indexer comprises a lever arm whereby the lever arm separates a balloon/valve combination selected for inflation from the other balloon/valve combinations positioned in the balloon support structure.

9. A balloon vending machine, comprising:

a balloon support structure for receiving a plurality of balloon/valve combinations;

a rotator mechanism for rotating the balloon support structure;

an indexer for selecting a balloon/valve combination to be inflated and released;

an inflator for inflating the selected balloon/valve combination and transporting balloon/valve combination selected by the indexer to a chamber after the balloon has been inflated; and a controller for receiving signals and controlling the rotator mechanism and controlling the inflator.

10. A balloon vending machine as recited in claim 9, wherein the plurality of vertical rails are spaced circularly around a common center axis and the carousal frame has a disk for holding the vertical rails in a fixed position.

11. A balloon vending machine as recited in claim 9, wherein the rotating means further comprises an electric motor coupled to the center shaft for rotating the shaft.

12. The apparatus recited in claim 9, wherein the inflator inflates and transports the balloon/valve combination selected by the indexer.

13. The apparatus recited in claim 9, wherein the inflator moves along a horizontal and a vertical plane.

14. The apparatus recited in claim 13, wherein the inflator is powered by a pneumatic cylinder.

15. The apparatus recited in claim 9, wherein the balloon storage carousal is positioned on a base plate, with the base plate having an opening to receive the inflator.

16. The apparatus recited in claim 9, wherein the inflator inflates the balloon/valve combination while the indexed balloon/valve combination is generally maintained in its pre-indexing position within the support structure.

17. The apparatus of claim 9, wherein the indexer comprises a lever arm whereby the lever arm separates one balloon/valve combination selected for inflation from the other balloon/valve combinations positioned in the balloon support structure.

18. The apparatus of claim 9, wherein the inflation nozzle inflates the balloon/valve combination within a chamber formed by the balloon support structure and transports the inflated balloon/valve combination to a position outside the support structure after the balloon/valve combination has been inflated.

19. A balloon vending machine, comprising:

a plurality of vertical rails, operably spaced for receiving a plurality of balloon/valve combinations;

a carousal frame for securing the vertical rails in a fixed position to the carousal frame having an upper disc and lower disc each having a generally circular configuration with the;

a rotation mechanism for rotating the vertical rails;

an indexer for selecting balloon/valve combination to be inflated;

an inflator for inflating and transporting balloon/-valve combination selected by the indexer;

a rail support bracket affixed to the inflation nozzle for preventing the balloon/valve combination selected for inflation from becoming dislodged from the vertical rails;

a controller for receiving signals and controlling the rotation mechanisms.

20. The apparatus of claim 19, wherein the inflator further comprises of an up/down cylinder and an in/out cylinder to control the movement of the inflation nozzle.

21. An apparatus as recited in claim 19, wherein the inflator further comprises a nozzle for inflating balloon/valve combination.

22. An apparatus as recited in claim 19, wherein the controller further comprises a programmable logic controller.

23. A balloon vending machine as recited in claim 19, wherein the control means further comprises coin slot means for producing one or more signals in response to a predetermined amount of monetary consideration.

24. An apparatus or claim 19, wherein the controller further comprises an electric switch sensor for indicating the position of the vertical rails with respect to the inflation nozzle.

25. An apparatus as recited in claim 19, wherein the plurality of vertical rails are circularity spaced around a common center axis.

26. A balloon vending machine, comprising:

a plurality of vertical rails, operably spaced for receiving a plurality of balloon/valve combinations;

a carousal frame for securing the vertical rails in a fixed position with respect to each other;

a rotation mechanism for rotating the vertical rails;

an indexer located inside the carousal frame for selecting balloon/valve combination to be inflated and released;

an inflator for inflating the selected balloon/valve combination and then releasing the inflated balloon/valve combination selected by the indexer from the carousal frame;

a controller for receiving signals and controlling the rotation mechanism and controlling the inflator; and a balloon hatch allowing the balloon/valve combination to be removed from the balloon vending machine.

27. An apparatus as recited in claim 26, wherein the balloon hatch prohibits an operator of the balloon vending machine access to the vertical rails.

28. An apparatus as recited in claim 27, wherein the balloon hatch further comprising a front door hingedly connected to balloon vending machine.

29. An apparatus as recited in claim 26 wherein the balloon hatch forms an upper chamber and a lower chamber separated by a balloon trap door.

30. An apparatus as recited in claim 26, wherein the controller further comprises an electric switch sensor for indicating the position of the vertical rails with respect to the inflation nozzle.

* * * * *